US007887232B1

(12) United States Patent
Jones, Jr.

(10) Patent No.: US 7,887,232 B1
(45) Date of Patent: Feb. 15, 2011

(54) MINIMUM-SPEED GAME TIMER

(76) Inventor: Royal C. Jones, Jr., 44 Lakeview Dr., Narragansett, RI (US) 02882

( * ) Notice: Subject to any disclaimer, the term of this patent is extended or adjusted under 35 U.S.C. 154(b) by 0 days.

(21) Appl. No.: 12/583,440

(22) Filed: Aug. 20, 2009

(51) Int. Cl.
*G04F 3/00* (2006.01)

(52) U.S. Cl. ..... 368/96; 368/110

(58) Field of Classification Search ..... 368/96, 368/89, 94, 109, 107–108, 110–112
See application file for complete search history.

(56) References Cited

U.S. PATENT DOCUMENTS 3,624,926 A * 12/1971 McCaughey ..... 434/179
4,062,180 A 12/1977 Meshi et al.
4,079,583 A 3/1978 Larsen
4,362,393 A * 12/1982 Tissot ..... 377/20
4,472,067 A 9/1984 Richardson et al.
4,510,485 A * 4/1985 Tahara ..... 340/323 R
4,681,463 A * 7/1987 Bendit ..... 368/96
4,884,255 A 11/1989 Fischer
4,995,018 A * 2/1991 Edwards ..... 368/107
5,140,564 A * 8/1992 Rich ..... 368/107
5,357,487 A * 10/1994 Coleman, III ..... 368/10
5,420,830 A 5/1995 Camaratta, Jr. et al.
5,642,334 A * 6/1997 Liberman ..... 368/10
5,796,680 A 8/1998 Franklin
5,796,681 A * 8/1998 Aronzo ..... 368/10
6,104,674 A 8/2000 Emoff et al.
6,326,883 B1 * 12/2001 Whitehead et al. ..... 340/309.8
6,346,055 B1 * 2/2002 Rege ..... 473/409
6,795,375 B2 * 9/2004 Streja ..... 368/10
6,975,563 B2 * 12/2005 de Brito ..... 368/109
2002/0093882 A1 7/2002 Garlock
2003/0026172 A1 2/2003 Eagle
2004/0008589 A1 * 1/2004 McMillan et al. ..... 368/223
2004/0145114 A1 7/2004 Ippolito et al.
2005/0243655 A1 * 11/2005 McCutcheon et al. ..... 368/107

* cited by examiner

*Primary Examiner*—Sean Kayes

(57) ABSTRACT

A game timer, especially suited in one embodiment as a chess clock, including means for direct input of minimum average playing speed in moves per unit time as well as input of the required number of moves in one or more time control sequences. Direct input means that minimum average speed is not inferred from the number of moves to be completed over an initially allotted period of time, as in conventional chess clocks, but is instead input as number of moves per hour or per minute. The units of time are established by a separate input. The separate inputs of minimum average speed and number of moves per time control sequence generate an initial allotted time automatically, which provides a ready means of enforcing the input minimum average speed. With the number of moves in a time control sequence set to one, the timer emulates a Fischer Clock.

19 Claims, 9 Drawing Sheets

MINIMUM-SPEED GAME TIMER

CROSS-REFERENCE TO RELATED APPLICATIONS

Figure 1A:
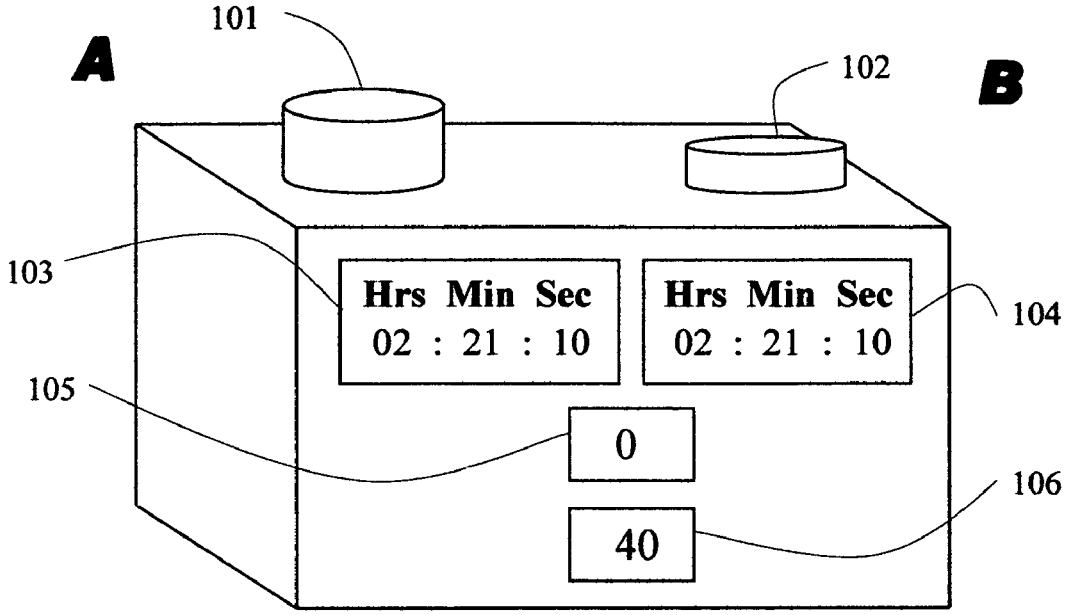

This application is related to application Ser. No. 11/481,870, filed Jul. 6, 2006, abandoned.

FEDERALLY SPONSORED RESEARCH

Not Applicable

SEQUENCE OR PROGRAM

Not Applicable

BACKGROUND

1. Field of Invention

This invention relates to game timers, specifically to chess clocks.

2. Prior Art

Game timers designed to limit the thinking time of contestants are used primarily in chess, where they are known as chess clocks. Mechanical chess clocks came into use in the late 1800's and were beginning to replace sandglasses by 1880. They were used exclusively in the London international chess tournament of 1883.

A chess clock actually comprises a pair of clocks running alternately. Each clock is controlled by a switch, usually in the form of a pushbutton. Once the device has been started, the pushbutton associated with the clock that is running stops that clock and starts the clock on the other side. After a player makes a move on the board, that player pushes the button on his/her side, which stops his/her clock and starts the opponent's clock. This action is said to complete the player's move. The opponent then begins consideration of the next move and pushes the button associated with his/her clock after the move is made. The cumulative time spent by each player over the course of the game is registered separately, counting down from time initially allotted on each clock. The players are required to complete a certain number of moves within the time initially allotted. Overstepping the time limit by either player results in forfeit of the game.

The occurrence of a time forfeit with a mechanical clock can be determined precisely by a small trip lever or flag, designed to fall just as the minute hand of the running clock reaches the top of the hour. In modem digital versions of the chess clock, which first appeared in the 1970's, overstepping the time limit is signaled by various alarm mechanisms, either audio or visual. Digital chess clocks, powered by an electrical source, are similar in operation to mechanical chess clocks from the standpoint of the user. An important advantage of the digital mechanism is that it makes possible variations on the traditional chess clock, such as the Fischer Clock described below. The term chess clock hereafter will imply a digital chess clock unless otherwise specified.

Time Controls and Playing Speed

The time limit to be enforced by a chess clock is known as a time control. A time control traditionally specifies a number of moves to be completed within a period of time, for example, forty move in two hours. If a game produces no result after the required number of moves, a secondary time control goes into effect. The secondary time control is typically different from the primary time control, perhaps twenty moves per hour (as compared with forty moves in two hours).

Each player is credited with unused time from the previous time control. In the example chosen, one hour is added to the respective times upon completion of the initial forty moves on each side, and a sequence of twenty moves begins. A similar procedure, favored for its simplicity in digital clocks, is to allow the initial time to run its course, proceeding to the next time control only after the allotted time has been used up. If a player has then completed more than the required number of moves, he/she will have fewer moves to complete in the next time control. This variation in implementation depends on how the boundary between time controls is defined. If the time control is viewed as ending after the required number of moves, the time remaining is carried over the next time control. If the time control is viewed as ending after the prescribed period of time, the number of moves completed beyond the required number is carried over. By either procedure, the secondary time control may be followed, if necessary, by a tertiary time control with further variation on the basic time limit, or time controls may simply be repeated to the end of the game.

There is an important distinction to be made between the terms time control and playing speed. Playing speed refers to the number of moves completed in a standard unit of time, either minutes or hours. The traditional time control implies a specific playing speed. For example, a time control of forty moves in two hours implies a playing speed of twenty moves per hour. A given playing speed, on the other hand, may be implemented by any number of time controls. Thus, twenty moves per hour may be implemented by a time control of forty moves in two hours, twenty moves in one hour, ten moves in thirty minutes, and so forth.

Sudden-Death Time Controls

The end of a time control in serious competition is often the occasion to break off play for as much as a day or two. This poses a problem for the scheduling of tournaments. In recent years a radically different time control, known as sudden death, has become popular for amateur events. A sudden-death time control requires that all of the moves in a game be completed within a specified period of time allotted to each player. Thus, a time control of SD/60 means that each player must complete all of his/her moves within 60 minutes, and a game consequently cannot go longer than two hours. Sudden death often produces a time scramble for either or both players, where an indefinite number of moves must be completed within an ever-diminishing period of time. The pressure to avoid a time forfeit, besides taking its toll on the players, leads to low levels of chess that may descend into outright farce. Time scrambles are not uncommon under traditional time controls, though perhaps less severe. Under either type of time control, players tend to spend a great deal of time on their early moves, looking for a decisive advantage. If the advantage does not materialize, a time scramble may result.

The Fischer Clock

The problem of time scrambles was addressed by a 1988 invention of Robert J. Fischer (U.S. Pat. No. 4,884,255), called the Fischer Clock. In its main embodiment the Fischer Clock features a sudden-death time control that expands as moves are completed. The clock mechanism adds a predetermined amount of time, typically one or two minutes, to a player's remaining time for every move that he/she completes. The awarded increment, like the initial allotment of time, is essentially arbitrary. Fischer pointed out that: (1) if a player spends time equal to the increment on each move, he/she will always have the initially allotted time remaining on his/her clock; (2) if a player spends less time than the increment on any move, he/she will thereby add time on his/her clock for use on future moves; and (3) if a player spends more time than the increment on any move, he/she will use up either time stored up from previous moves or time from the initial time period. This scheme usually manages to avoid severe time scrambles. A disadvantage of the Fischer clock is that its time control bears no obvious relation to speed of play, on which traditional time controls are based (as, for example, forty moves in two hours). It may be for this reason that the Fischer Clock has not been widely adopted. Players using the clock have been known to complain that even the slowest of their opponents always seem to have a minute or two remaining.

Time Delays

Somewhat more popular as a means for combating time scrambles is a digital clock that provides a time delay on each move (U.S. Pat. No. 5,420,850 to Cameratta et al., 1995). With this device a player's clock does not begin to count down precisely when the opponent's clock is stopped. There is instead a small delay, typically five seconds, which amounts to free thinking time for the player on the move. A player will always have, at a minimum, the period of the time delay to complete his/her move This is essentially equivalent to awarding the free time as an increment after the player's move, as in the Fischer Clock. In contrast to the Fischer Clock, if a player does not use up all of the time delay in making a move, the unused time is not added to his/her clock. The fact that time is never added to time remaining, also that delays are typically quite small, makes this adaptation more or less compatible with traditional time controls.

Time delays over the course of a game tend, however, to distort the intended speed of play. Official rules of the United States Chess Federation ($5^{th}$ ed., 5F) provide that a tournament director has the right to deduct time from a time control in compensation for delay mode. The rule is applied mainly to sudden-death time controls, where the appropriate deduction is estimated from the number of moves required for a complete game. This estimate is necessarily crude since the actual number of moves required for a complete game varies widely. Another problem is that a player may not use up the entire period of the delay on any single move, particularly in time pressure. Consequently, the amount of additional free time accruing from a delay cannot be precisely determined.

SUMMARY

In accordance with one embodiment, the present invention includes a means for direct input of minimum average speed as the number of moves to be completed per unit time over a specified number of moves. Direct input means that minimum average speed is not inferred from the number of moves to be completed over an initially allotted time period as in conventional chess clocks. Instead, minimum average speed and the number of moves to be completed are established independently by separate inputs.

This design has several unexpected advantages, as will be seen from the subsequent description of the invention. The separate inputs of minimum average speed and required number of moves together generate the initial period of time automatically, which provides a ready means of enforcing minimum average speed. An incidental advantage is that certain features of the Fischer Clock are incorporated.

DRAWINGS

Figures

Closely related figures appearing in the same drawing have the number of the drawing followed by an alphabetic suffix. Reference numbers are prefixed by the number of the drawing in which they appear.

Figure 1B:
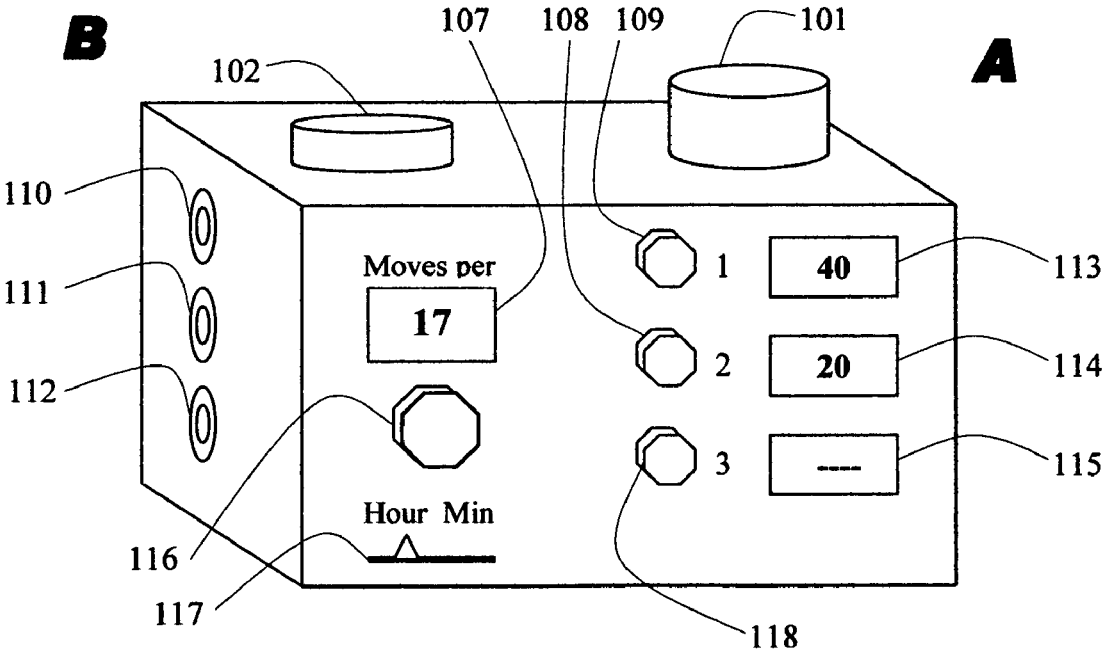

FIGS. 1*a* and 1*b* show a first embodiment of the minimum-speed game timer, front and back.

Figure 2:
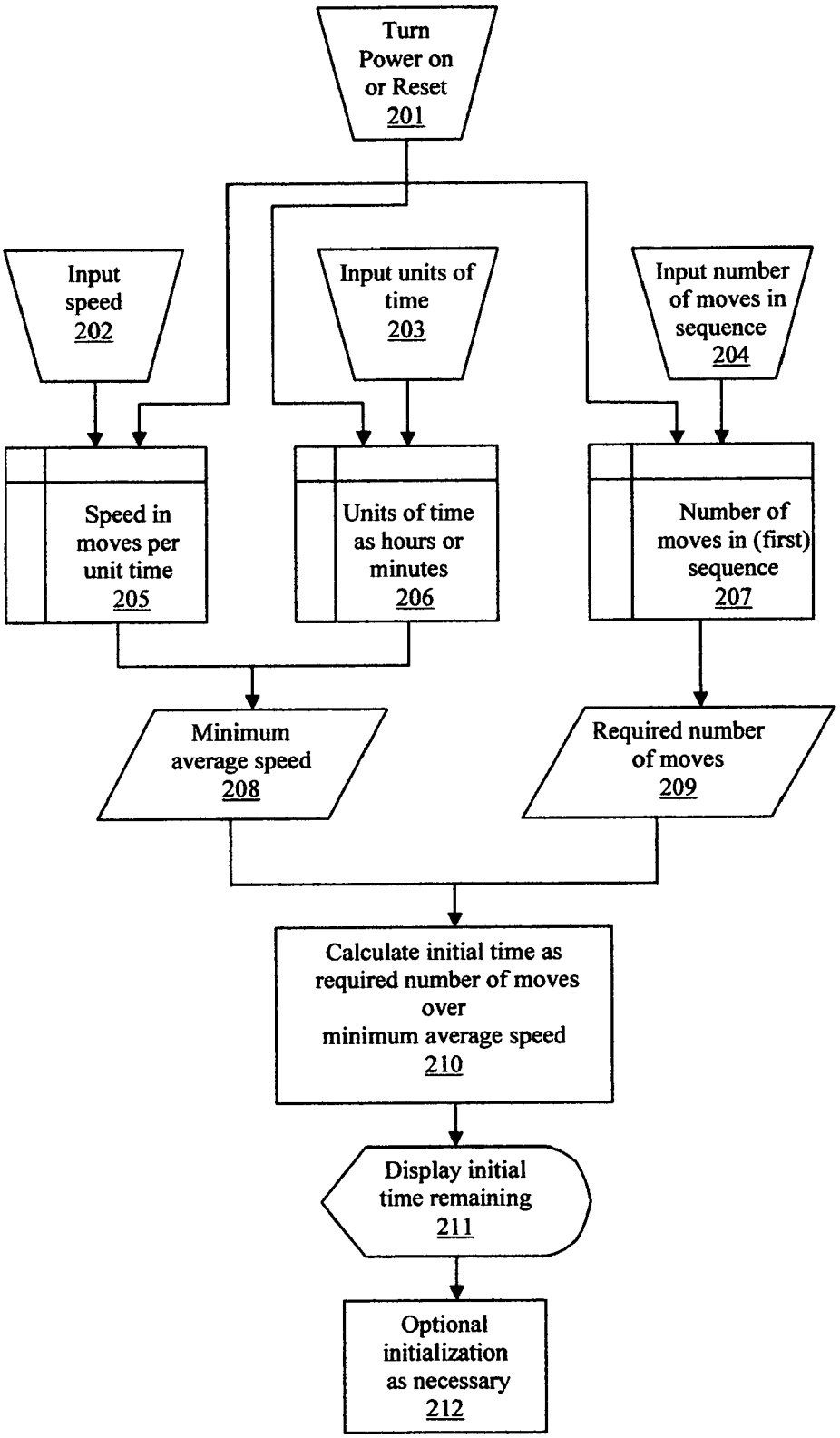
Figure 3A:
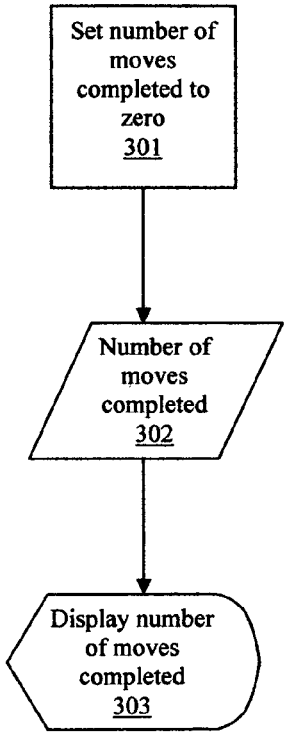
Figure 3B:
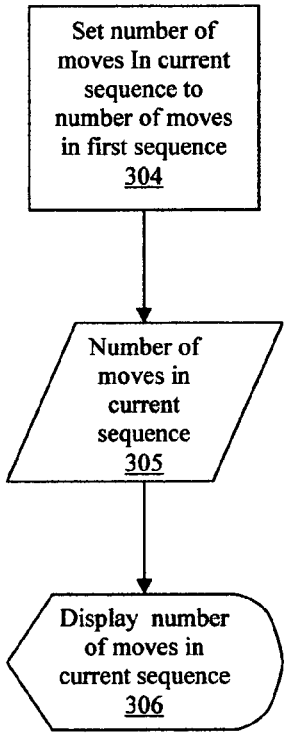
Figure 3C:
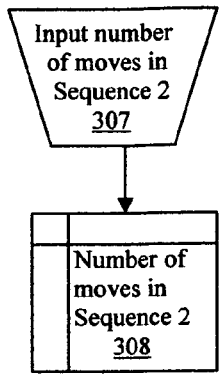
Figure 3D:
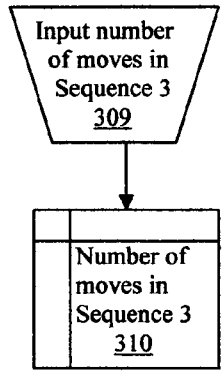

FIG. 2 is a flowchart for initialization of input in all three embodiments.

FIGS. 3*a* to 3*d* are flowcharts for supplementary initialization in the first embodiment.

Figure 4:
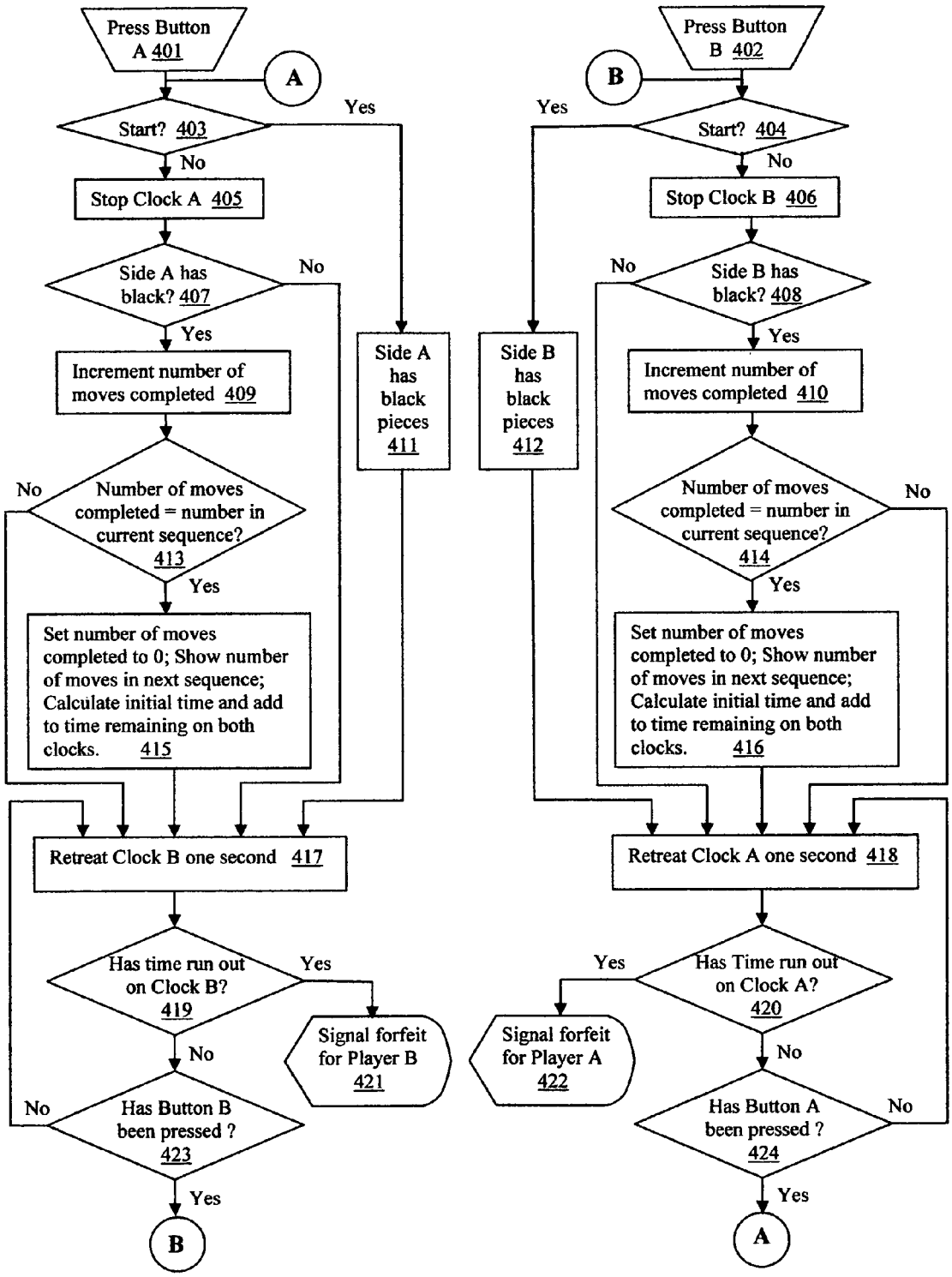

FIG. 4 is a flowchart for the operation of the first embodiment.

Figure 5A:
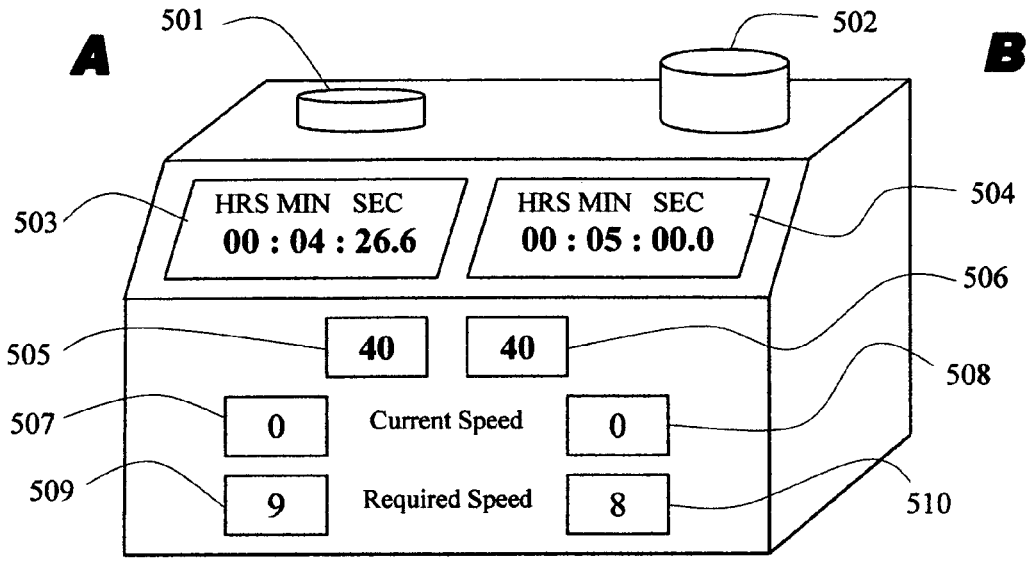
Figure 5B:
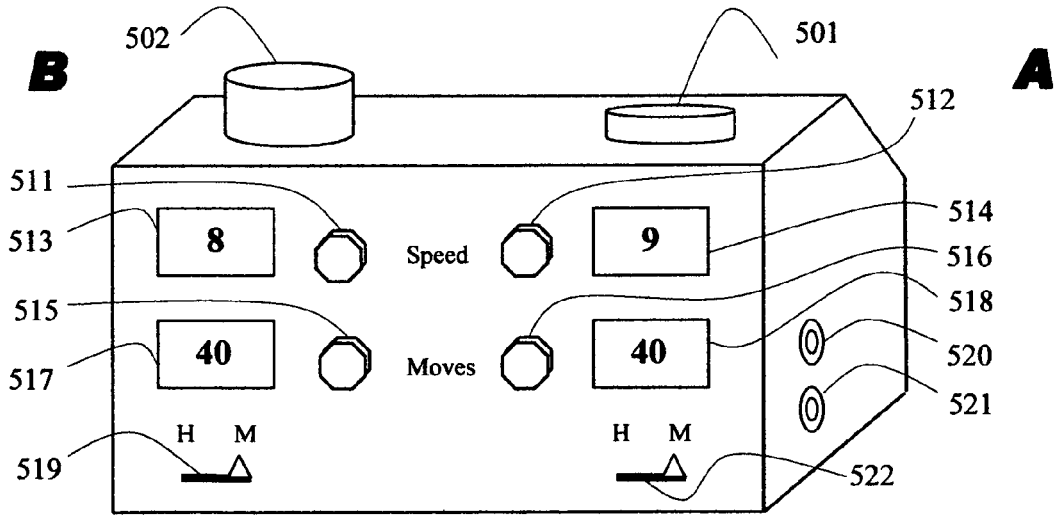

FIGS. 5*a* and 5*b* show a second embodiment of the minimum-speed game timer, front and back.

Figure 6A:
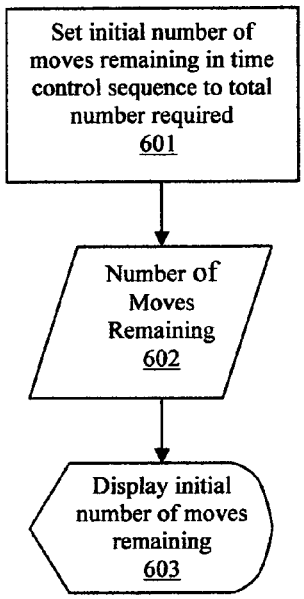
Figure 6B:
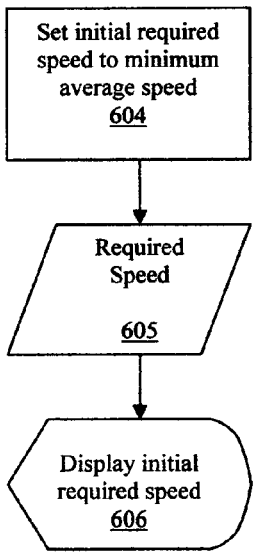
Figure 6C:
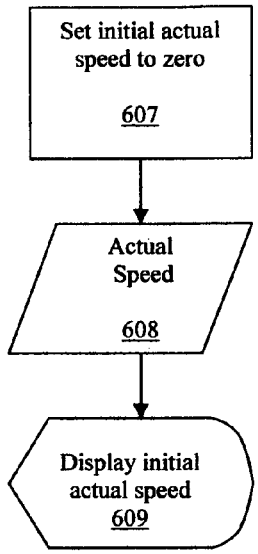

FIGS. 6*a* to 6*c* are flowcharts for supplementary initialization in the second embodiment.

Figure 7:
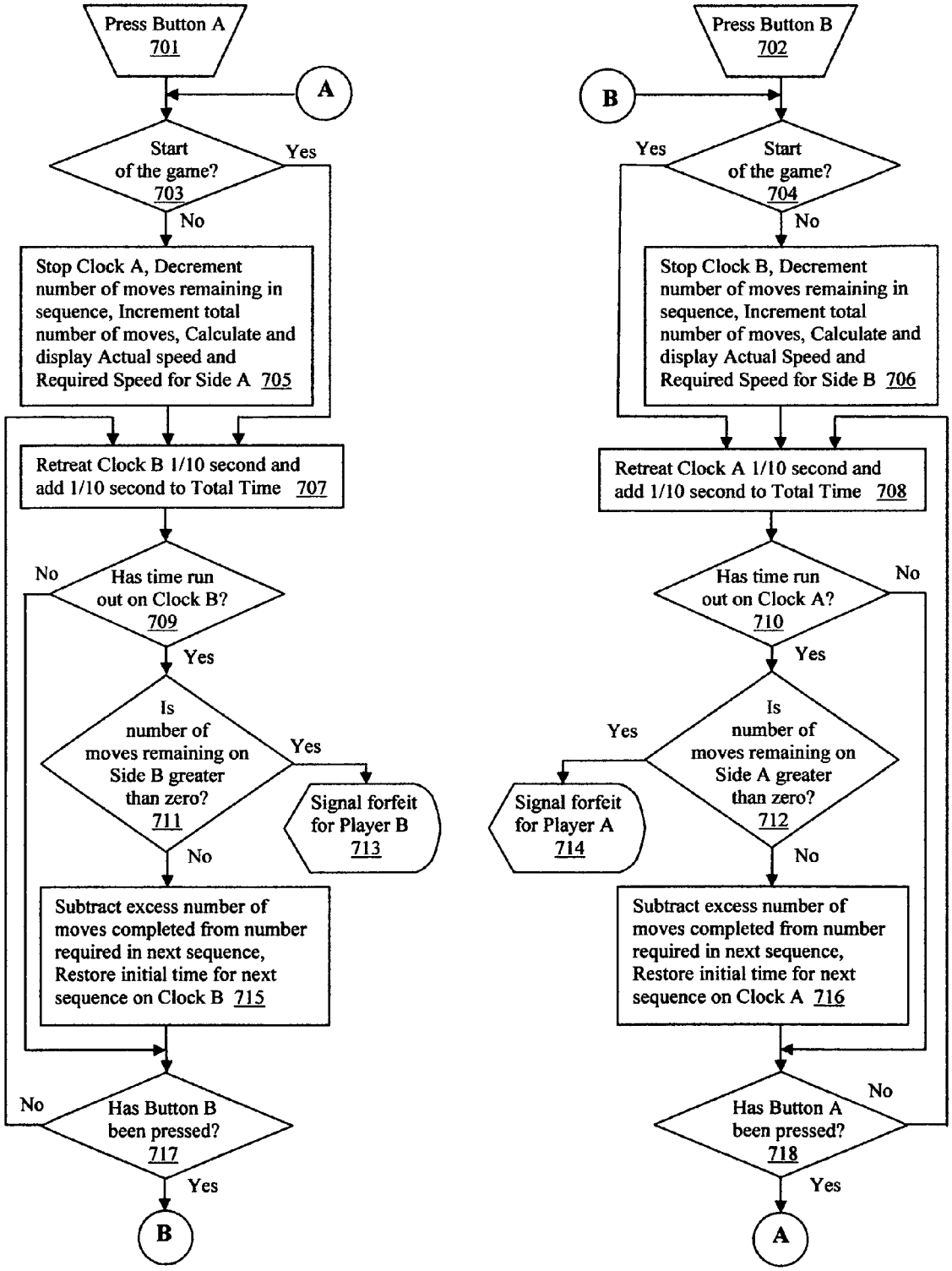

FIG. 7 is a flowchart for the operation of the second embodiment.

Figure 8A:
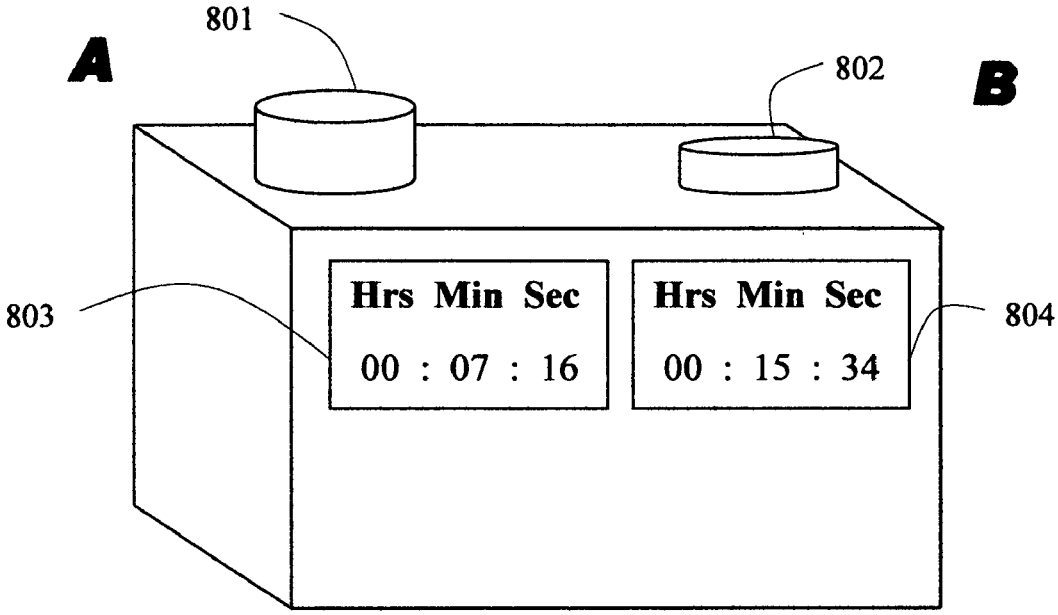
Figure 8B:
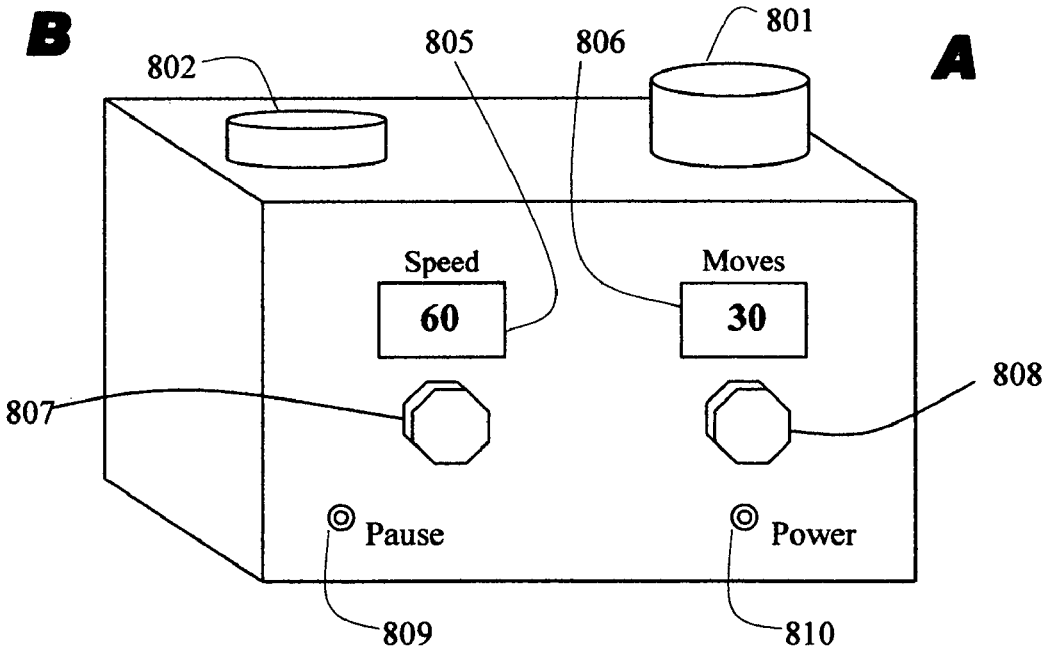

FIGS. 8*a* and 8*b* show a third embodiment of the minimum-speed game timer, front and back.

Figure 9:
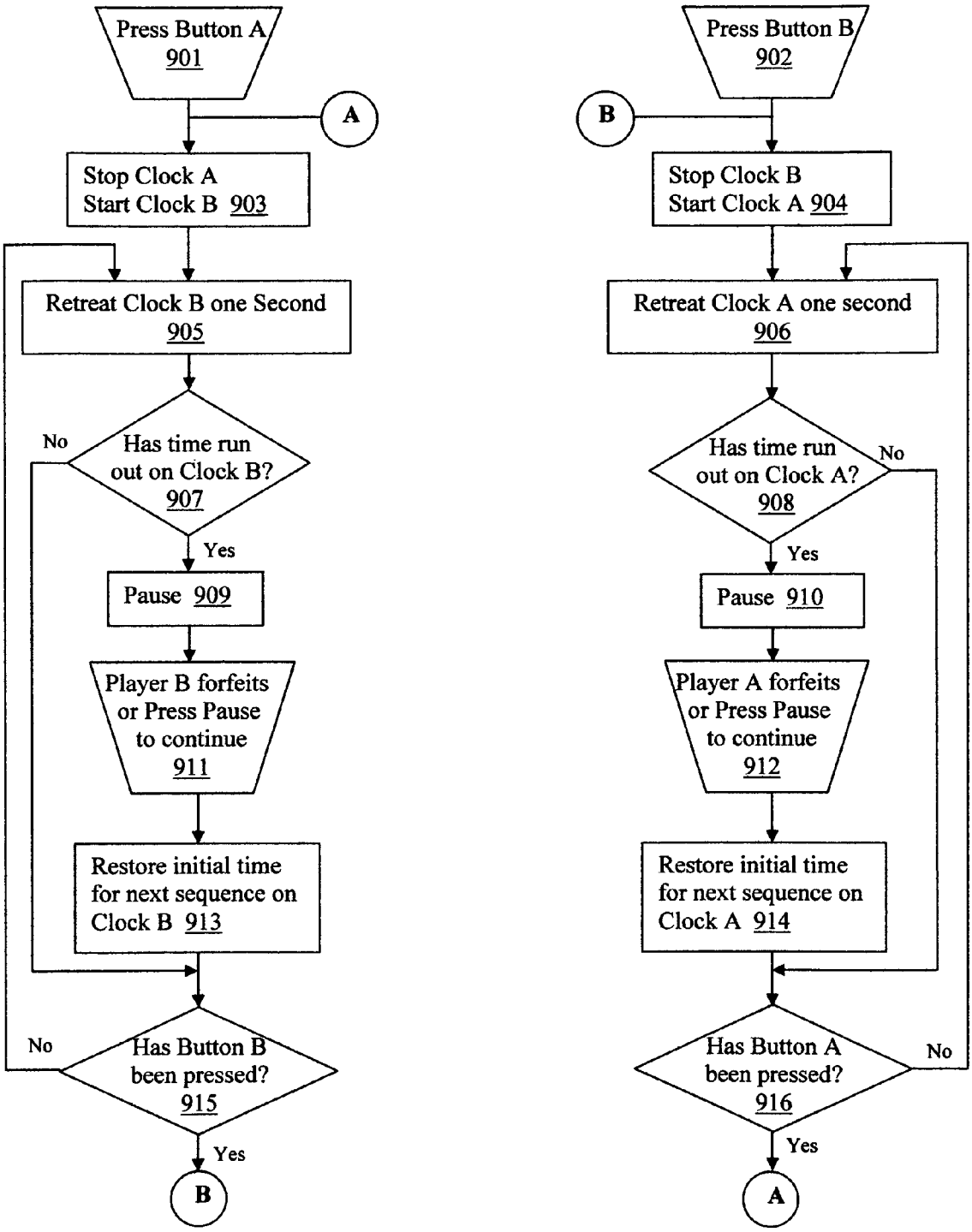

FIG. 9 is a flowchart for the operation of the third embodiment.

DETAILED DESCRIPTION

First Embodiment

FIG. 1*a* shows a front view of the first embodiment, which features three separate inputs for time control sequences. (The term time control sequence is used in contradistinction to the time control of conventional chess clocks, from which playing speed is inferred. Here minimum average speed is established independently.) On top are buttons 101 and 102 for completing and initiating moves, with 102 in a depressed position. Displays 103 and 104 show time remaining on the respective sides in hours, minutes, and seconds. Display 105 shows the number of full moves completed or, equivalently, the number of moves completed by the player with the black pieces. With Black on the move, 105 displays a number that is one less than the number of moves completed by White. The display is always accurate, however, with respect to the number of moves completed by the player on the move. Showing the number of full moves completed eliminates the need for separate displays for each side. Display 106 shows the required number of moves in the current time control.

FIG. 1*b* shows the rear view of the first embodiment. Buttons 110, 111, and 112 are for power, reset, and pause respectively. Display 107 shows the minimum average playing speed, which is input by manipulation of knob control 116. Manipulation of the slide control 117 determines whether the units of time for playing speed are per hour or per minute. Displays 113, 114, and 115 show the required number of moves in each of three time control sequences respectively. A blank display, as in 115, indicates that the required number of moves in the previous time control sequence is to be repeated in subsequent sequences.

Operation

First Embodiment

FIG. 2 is a flowchart for the initialization process characteristic of all embodiments described herein. This initialization is triggered by any of the manual operations depicted at the top of the flowchart (201 to 204). Turning the power button on has the same effect as pressing the reset button (201) except that the latter does not affect power. Either manual process causes the values stored in nonvolatile storage 205 to 207, by previous inputs or by factory settings, to access and display the values for minimum average speed (208) and the required number of moves in the time control sequence (209). These values are then used to calculate the initial time displayed on each clock. The other manual procedures 202, 203, and 204 are for input of values into nonvolatile storage 205, 206, and 207 respectively. These values persist when the timer is turned off. The input of playing speed (202) is stored in 205; the input of units of time (203) is stored in 206; and the input of the required number of moves in the time control sequence (204) is stored in 207. Any of the manual input procedures, 202 to 204, also causes recalculation of the initial time displayed on each clock.

The circuitry of the timer causes it to perform integer (short) division of the required number of moves in a sequence by the minimum average speed, where the unit of time is expressed in seconds (e.g., 20 moves/60 sec or 20 moves/3600 sec). This yields a truncated value for the number of seconds in the initial time on each clock. (Note that division by speed is equivalent to multiplication by the reciprocal of speed). The number of seconds is then converted to hours, minutes, and seconds. For the first sequence of 40 moves at a minimum average speed of 17 moves per hour, as illustrated in FIG. 1*b*, the initial number of seconds would be 8470. This truncated value is then converted to 2 hours, 21 minutes, and 10 seconds, as illustrated in FIG. 1*a*. The timer mechanism greatly facilitates the calculation of initial time and thus allows a full range of playing speeds. Initial time is calculated so that minimum average speed can be enforced over of the specified number of moves in the time control sequence, as will be explained further in the section on theory. Other initialization processes (212) may be necessary for particular embodiments and will be described separately.

FIGS. 3*a* to 3*d* show supplementary initialization processes required for the first embodiment. The processes of 3*a* and 3*b* are extensions of the basic initialization shown in FIG. 2. In 3*a* the number of moves completed in the current time control sequence (302) is set to zero (301) and displayed accordingly (303, in 105 of FIG. 1*a*). In 3*b* the required number of moves in the current time control sequence (305) is set to the required number in the first sequence (304) and displayed accordingly (306, in 106 of FIG. 1*a*). Optional manual processes include inputs for the required number of moves in the second time control sequence (307) and the third time control sequence (309). These are stored in nonvolatile storage 308 and 310 respectively. If 308 and 310 contain zero values, the corresponding displays 114 and 115 are blank. In that case, the first time control sequence is repeated over the course of the game. The manual processes 307 and 309 do not trigger the basic initialization of FIG. 2.

FIG. 4 is a flowchart for operation of the first embodiment. Alternative methods of operation are possible using different transitions from one time control sequence to the next, as will be seen in other embodiments. Here the end of a time control sequence is determined by completion of the required number of moves in a sequence. After initialization (FIGS. 2 and 3), operation begins by pressing either move button (401 or 402). In chess the player with the black pieces presses the button on his/her side, A or B in FIGS. 1*a* and 1*b*. Let us assume for the sake of simplicity that the player with the black pieces is seated on side B. That player presses button 102 to start play (402). Since no moves have been made (404), side B is registered as the side with the black pieces (412). The clock on side A starts immediately, and the countdown by seconds begins (418). If time runs out on clock A (420), the timer signals that Player A has forfeited on time (422). If Player A has pressed his/her button (424), operation shifts to the other side (connector A). Otherwise, the countdown continues (418), and the time remaining is displayed in 103 of FIG. 1*a*. On completion of the move (401), since the first move of the game has already been made (403), the clock on side A is stopped (405). If the player on side B has the black pieces (407), as has been assumed, Clock B is started immediately (417). If, on the other hand, the player on side A had the black pieces (407), pressing the button on his/her side (401) would have completed of a full move. The number of moves completed would then be incremented by one (409) and displayed in 105. If this completed the required number of moves in the sequence (413), the number of moves would be reset to 0 and displayed in 105; the number of moves in the next sequence would be displayed in 106; and the time initially allotted for the next time control would be added to the time remaining each clock respectively (415). The adjusted times would then be displayed in 103 and 104. The assumption, however, is that side A does not have the black pieces, in which case steps 409, 413, and 415 are passed over.

The clock on side B is then started (417). Operation proceeds in a fashion similar to that already described for the other side of FIG. 4. If time runs out on Clock B (419), the timer signals that Player B has forfeited on time (421). If Player B has pressed his/her button (423), operation shifts to the other side (connector B); otherwise, the countdown by seconds continues (417) and is displayed in 104 of FIG. 1*a*. On completion of the move (402), since play has already begun (404), the clock on side B is stopped (406). Our simplifying assumption was that the player on side B has the black pieces (408). In that case, the number of full moves completed is incremented by one (410) and displayed in 105. If the time control sequence has been completed (414), the number of moves is reset to 0 and displayed accordingly in 105; the number of moves in the next time control sequence is displayed in 106; and the time allotted for the next time control sequence is added to the time remaining on each clock respectively (416). Since Black has moved, a full move has been completed. Clock A starts again (418), and the results are displayed in 103 and 104. The cycle continues until the game yields an outcome.

Second Embodiment

FIG. 5*a* shows a front view of the second embodiment, which features separate inputs for the two sides. Also featured are displays of the playing speed required to satisfy the minimum average (509 and 510) and displays of the actual speed up to the current move (507 and 508). On top are move buttons 501 and 502. The displays 503 and 504 show time remaining in hours, minutes, seconds, and tenths of a second. Displays 505 and 506 show the number of moves remaining in the time control sequence on each side respectively, not the number of moves completed as in the first embodiment. Displays 507 and 508 show the current playing speed of each player for the number of moves thus far completed on each side respectively. Displays 509 and 510 show the playing speed required of each player over the moves remaining in the respective time control sequences to avoid a time forfeit.

FIG. 5*b* shows the back view of the second embodiment with separate input controls for each player. 511 and 512 are knob controls for setting the minimum average speed required of each player respectively. 513 and 514 are displays for the minimum average speeds thus set. 515 and 516 are knob controls for setting the required number of moves in the time control sequences of each player respectively. 517 and 518 are displays for the number of moves thus set. 519 and 522 are slider controls for setting the units of time for the minimum average speed of each player respectively. 520 is a pause button. 521 is a power switch, serving also as a reset button in this embodiment.

Operation

Second Embodiment

The initialization process of FIG. 2 applies to the second embodiment, but here it is a separate process for each player. As a consequence, different initial times, displayed in 503 and 504, are possible. Time displays in the second embodiment are extended to tenths of a second. The circuitry for measuring time in tenths of a second requires a more rapid cycle, but calculations may be done by the usual integer arithmetic. For the calculation 210 of FIG. 2 the required number of moves in the time control sequence is first multiplied by 600 if the units of time are minutes, and by 36000 if the units of time are hours. The result after short division by the number of moves per unit time is the initial time in tenths of a second, which is then converted to hours, minutes, seconds, and tenths of a second. The settings illustrated in FIG. 5*b* have the player on side B playing at eight moves per minute over a sequence of 40 moves, equivalent to the once common time control in speed chess of 40 moves in five minutes. The initial time is shown in 504 as exactly five minutes, converted from 300.0 seconds. The player on side A is given the handicap of a slightly faster playing speed: nine moves per minute over a sequence of 40 moves, which generates a truncated initial time of 266.6 seconds, converted in display 503 to 4 min, 26.6 sec.

The processes described in FIGS. 6*a* to 6*c*, also separate for each player, show further initialization required in the second embodiment. The number of moves remaining (602) on each side is initially set to the required number of moves in each side's time control sequence (601), and displayed accordingly (603) in 505 and 506 respectively. Initial required speed (605) is set to the minimum average speed established for each player respectively (604) and is displayed (606) in 509 and 510 respectively. Initial actual speed (608) is set to zero for both sides (607) and is displayed (609) in 507 and 508.

FIG. 7 is a flowchart for the operation of the second embodiment, which employs a different transition from one time control sequence to another, as compared with the first embodiment. In the first embodiment a time control sequence ends when the required number of moves is completed. Here a time control sequence ends when the allotted time runs out. As a consequence, a sequence may be extended beyond the number of moves required. After initialization (FIGS. 2 and 6), operation begins by pressing either button (701 or 702). If the player with the black pieces is on side B, that player starts the game by pressing 502. At the beginning of play (704), the clock on side A is immediately started and the countdown by tenths of a second begins (708). The total elapsed time, which is recorded in a separate register (not shown), is incremented by one-tenth of a second (708). If time runs out on clock A (710), it is then determined whether Player A has moves yet to be completed in the time control (712). If so, the timer signals that Player A has forfeited on time (714). If Player A has completed at least the required number of moves, the number of moves completed in excess of the required number (if any) is subtracted from the number required for the next time control sequence (716), and the result is displayed in 505. Since the number of moves remaining is stored as a signed number, it may also be said that the excess is added algebraically to the number required for the next sequence. Negative numbers, as the number of moves in excess of the required number, are displayed distinctively in 505 and 506, perhaps in a different color. With the number of moves remaining thus determined, the allotted time for the next sequence is calculated and displayed on Clock A (716). In this embodiment the time allotted for a time control sequence is repeated on each side from one sequence to the next, though the repeated time may be different for each side. If Player A has completed the move without a time forfeit (718), operation shifts to the other side (connector A). Otherwise, the countdown continues (708) as displayed in 503 of FIG. 5*a*. When Player A has pressed the button on his side (701), the clock on side A is stopped since play has already started (703), and the number of moves completed in the time control by Player A is decremented by one (705). The result is displayed in 505. Also, the total number of moves completed by Player A is incremented by one and stored internally in a separate register (not shown, 705).

In this embodiment the number of moves yet to be completed is displayed just below the time remaining, allowing the players an immediate grasp of the current time constraints. Having just completed a move, Player A may also check display 509 for the playing speed required over the remaining moves of the time control sequence to avoid forfeit. It is calculated (705) by dividing the number of moves remaining by the time remaining time in tenths of a second, multiplying first by 600 or by 36000, to obtain truncated values for moves per minute or moves per hour respectively. (If the number of moves remaining is negative, the required speed is set to zero and displayed accordingly). Player A's actual speed up to and including the move just completed is obtained by a similar calculation, dividing the total number of moves completed by the total elapsed time (705), and is displayed in 507.

The clock on side B is then started, and operation proceeds as previously described for side A. One-tenth of a second is subtracted from clock B and added to the total elapsed time for side B (707). If time runs out on Clock B (709) and Player B has moves yet to be completed (711), the timer signals that he/she has forfeited on time (713). If the number of moves remaining is negative after time has run out on Clock B, its absolute value is subtracted from the required number of moves in the next time control sequence, that is, its value is added algebraically (715). The required number of moves is displayed in 506. Also, the time allotted for the next time control sequence, which in this embodiment is repeated from the previous time control sequence on the respective sides, is calculated and displayed on clock B (715). If Player B completes the move successfully (717), play shifts back to the other side (connector B). The clock on side B is stopped (706) since play has already started (704). The number of moves completed by Player B is decremented by one (706), and the result is displayed in 506. The total number of moves completed, maintained in a separate internal register (not shown), is incremented by one (706). Using stored values for total number of moves completed and total elapsed time, Player B's actual speed up to this point is calculated and displayed in 508. Finally, the speed required for Player B to avoid forfeit over the subsequent moves of the time control sequence is calculated, as described above, and displayed in 510. Clock A starts again (708). At this point each side has completed a move. Play continues until a time forfeit occurs or the game otherwise reaches a conclusion.

Third Embodiment

The third embodiment is a minimal implementation of the minimum-speed game timer. It includes only those features necessary for its basic operations. FIG. 8*a* shows the front view. Buttons 801 and 802 are the move switches, with 802 depressed. Displays 803 and 804 are for the time remaining on each side.

FIG. 8*b* shows the back view of the third embodiment. 807 is a knob control for input of minimum average speed, which is displayed in 805. 808 is a knob control for input of the required number of moves in a time control sequence, displayed in 806. 809 is a toggle switch for pausing or resuming the operation of the timer. 810 is a power switch, serving also as a reset button.

Operation

Third Embodiment

The third embodiment does not keep track of the number of moves completed. The players are expected to do this in their individual recordings of the game, as required by U.S. Chess Federation's Rules ($5^{th}$ Ed., 15a). Since manual recording of the game is not practical for speed chess, the third embodiment is not suitable for this mode of play. The minimum average playing speed, as input by knob 807, is assumed to be in moves per hour.

The third embodiment employs the initialization process of FIG. 2. Further initialization is not required.

FIG. 9 is a flowchart for operation of the third embodiment. Assuming the player with the black pieces is seated on side B, that player begins play (902) by pressing button 802. The clock on side B is stopped if it is running, and clock A is started (904). One second is subtracted from the time remaining on clock A (906). If this exhausts the time remaining (908), operation of the timer pauses (910). This gives the players an opportunity to check their score sheets to determine whether player A has completed the required number of moves in the time control sequence, as displayed in 806 of FIG. 8*b*. If player A has not completed the required number, he/she forfeits on time. This means that the player's average speed over the moves of the current time control sequence (hence, over the moves of the entire game) has been less than the required minimum, as displayed in 805 of FIG. 8*b*. This is demonstrably true despite the minimal implementation (see theory below). If player A has completed more than the required number of moves when time runs out, he/she will then have fewer moves to complete in the time generated for the next time control sequence. If the players are in agreement that player A has completed at least the required number of moves, either may resume operation of the timer by pressing the pause button (912). If the players are not in agreement, an arbiter may be required. On resumption of play the time on clock A is restored to its initial value (914) since the allotted time is repeated in this embodiment. Once player A has completed the move (916), play switches to the left side of FIG. 9 (connector A). Otherwise, the clock continues to run on side A (906).

Player A having pressed button 801, operation of the timer mirrors the previous operation on side A. Clock A is stopped, and clock B starts (903), causing one second to be lost on Clock B (905). If time runs out on clock B (907), the'clock is paused as usual (909). Player B forfeits if he/she has not completed the required number of moves (911). Otherwise, either player presses the pause button 809 to resume play, and the initial time is restored to Clock B (913). When Player B completes the move (915), play continues on the other side of FIG. 9 (connector B), thus completing a full move.

CONCLUSION, RAMIFICATIONS, AND SCOPE

Accordingly, the reader will see that the minimum-speed game timer of the various embodiments can be used to enforce a minimum average speed in competitive activities, such as chess, by inputs that are relevant to this enforcement. A chess player considering participation in a tournament is likely concerned with two aspects of the advertised time controls: (1) the speed at which he/she will be required to play and (2) the number of moves over which this playing speed must be maintained. These are the values accepted by the minimum-speed game timer as direct input. Note that a player by this scheme does not have to maintain a specific playing speed move by move. As long as his/her average playing speed at the end of a time control sequence is at least the minimum required, a forfeit is avoided. It can be shown mathematically that, if a player forfeits on time using the minimum-speed game timer, his/her average playing speed over the course of the game has fallen short of the required minimum average. This is true regardless of the number of time controls that have been successfully completed.

Theory

The minimum-speed game timer enforces minimum average playing speed by processing the inputs M (the required number of moves in a time control sequence) and S (minimum average playing speed). The action of setting either M or S generates an initial time of M/S. For example, if the required number of moves in a time control sequence is 40 (M=40 moves) and the minimum average playing speed is 20 moves per hour (S=20 moves/hr), then the initial time is two hours. Suppose that a player forfeits on time in the first time control, and let N be the number of moves that he/she has completed. Since the player has forfeited, N is less than M. The average speed of the forfeiting player is the number of moves completed over the elapsed time:

$$\frac{N}{M/S}$$

or $$S\cdot(N/M),$$

which is clearly less than S. Suppose instead that the player forfeits in a subsequent time control, call it C, which requires that at least M' moves be completed at the minimum average playing speed S. (M' may be different from its initial value M). Let T be the total number of moves in the previous time control sequences, and let N' be the number of moves completed in C. The total number of moves completed is T+N' out of the total required T+M', and the total time expended is (T+M')/S. The average speed over the entire game is consequently $$\frac{T+N'}{(T+M')/S}$$

or $$S\cdot\frac{T+N'}{T+M'}.$$

Since the player has forfeited on time, N' is less than M'. Again, the average speed is clearly less than S.

An interesting case arises if there is only one move in the initial time control sequence (M=1). Suppose that this time control is repeated over the course of the game by the method described in FIG. 4, where initial time in a time control is added to time remaining from the previous time control. The result would be an increment of 1/S on the player's clock after each of his/her moves. For example, a playing speed of 10 moves per minute would produce an increment of 6 seconds after each move (1/10 min). This describes in essence the operation of the Fischer Clock. The minimum-speed game timer thus provides a version of the Fischer Clock that enforces minimum average playing speed. In contrast to the Fischer Clock, the initial time allotted in the minimum-speed game timer is not arbitrary, as this would make speed enforcement problematic. For a given speed S in the minimum-speed timer, initial time can be increased only by increasing M, the number of moves in a time control sequence. A larger value of M gives a degree of flexibility to the enforcement of minimum average speed since average speed may fall below the minimum over the course of a time control sequence without incurring forfeit. A smaller value of M, on the other hand, enforces minimum average speed more rigorously and thus reduces the risk of time scrambles, as in the Fischer Clock. Manipulating M gives rise to a spectrum of time controls, from one that has the effect of a Fischer Clock to more lengthy versions that resemble conventional time controls. The user thus has immediate access to a variety of time control methods.

Alternative Embodiments

Although the description above contains many specificities, these should not be construed as limiting the scope of the embodiment but merely providing illustrations of some of the presently preferred embodiments. For example, the switches that control stopping and starting of the clocks can be of various kinds, such as membrane switches, toggle switches, lever switches, touch sensors, etc. The switches may control the clocks by various means, such as by mechanical action, electronic circuits, optical beams, or remote control signals. A single switch may control both stopping and starting a single clock, or two clocks in alternation. The time displays can be in various configurations of hours, minutes, and seconds, which may vary in the course of a game, and the speed of the countdown can be in seconds, tenths of a second, hundredths of a second, etc. The input mechanisms can be of various sorts, including buttons, knobs, sliders, voice activation, etc.

Thus the scope of the embodiment should be determined by the appended claims and legal equivalents, rather than by the examples given.

I claim:

1. A timing device for timing two alternating sequences of events, comprising:

(a) a pair of clock means for displaying the time remaining for each of said sequences respectively, (b) a pair of switches coupled to said clock means, each of which starts one of said clock means and simultaneously stops the other of said clock means, whereby the time remaining for each of said sequences is measured, (c) a first means for input and storage of a minimum average speed as the number of said events per unit time over each of said sequences respectively, (d) a second means for input and storage of a required number of said events in each of said sequences respectively, (e) a third means, connected to said first means and to said second means, for calculating an initial period of time for each of said clock means, based on said minimum average speed and said required number of said events, whereby it can be determined whether or not said minimum average speed is maintained over said sequences of said events.

2. A timing device as claimed in claim 1 further comprising a means for input and storage of a unit of time for said minimum average speed.

3. A timing device as claimed in claim 1 further comprising a means, coupled to said pair of switches, for calculating and displaying the number of said events completed with respect to said number of required events in each of said sequences respectively.

4. A timing device as claimed in claim 1 further comprising a means, coupled to said pair of switches, for recording and displaying the number of said events remaining in each of said sequences respectively or, as a negative number, the number of events in excess of that required in each of said sequences.

5. A timing device as claimed in claim 1 wherein said first means is designed to accept and store as input a different minimum average speed for each of said sequences, whereby said minimum average speed may be set differently for each contestant according to his/her playing strength.

6. A timing device as claimed in claim 1 wherein said second means is designed to accept and store as input a different required number of events for each of said sequences, whereby said required number of events may be set differently for each contestant according to his/her playing strength.

7. A timing device as claimed in claim 1 wherein said pair of clock means is designed to calculate and display remaining time in tenths of a second.

8. A timing device as claimed in claim 1 further comprising (a) a first register, coupled to said pair of switches, for recording the number of events completed in each of said sequences respectively, (b) a second register, coupled to said pair of clock means, for recording the total elapsed time on each of said clock means respectively, (c) a fourth means, coupled to said first register and to said second register, for calculating and displaying current speed as said number of events completed over said total elapsed time for each of said sequences respectively.

9. A timing device as claimed in claim 1 further comprising (a) a first register, coupled to said pair of switches, for recording the number of events remaining in each of said sequences respectively, (b) a second register, coupled to said pair of clock means, for recording the time remaining on each of said clock means respectively, (c) a fifth means, coupled to said first register and to said second register, for calculating and displaying required speed as said number of events remaining over said time remaining for each of said sequences respectively.

10. A timing device as claimed in claim 1 further comprising:

(a) a toggle switch, designed (1) to cause said timer to suspend operation if said timer is running and (2) to cause said timer to resume operation if operation has been suspended, and (b) a pause mechanism, connected to said pair of clock means, designed to cause said timer to suspend operation automatically if time has run out on either of said clock means, whereby operation of said timer can be suspended manually for any reason or, if operation of said timer has been suspended automatically, it can be determined whether a time forfeit is warranted.

11. A timing device for timing two alternating sequences of events, each consisting of a succession of subsequences, comprising:

(a) a pair of clock means for displaying the time remaining for the current subsequence in each of said sequences respectively, (b) a pair of switches coupled to said clock means, each of which starts one of said clock means and simultaneously stops the other of said clock means, whereby the time remaining for the current subsequence in each of said sequences respectively is measured, (c) a first means for input and storage of a minimum average speed as the number of said events per unit time over each of said subsequences respectively in each of said sequences, (d) a second means for input and storage of a required number of said events in each of said subsequences respectively in each of said sequences, (e) a third means, connected to said first means and to said second means, for calculating an initial period of time for each of said subsequences respectively in each of said sequences, based on said minimum average speed and said required number of events in each of said subsequences respectively, whereby it can be determined whether or not said minimum average speed was maintained over the entirety of each of said sequences respectively.

12. The timing device as claimed in claim 11 wherein said first means is designed to accept and store as input a minimum average speed that is the same for each of said sequences and uniform for each of said subsequences in each of said sequences.

13. The timing device as claimed in claim 11 wherein said first means is designed to accept and store as input a minimum average speed that is different for each of said sequences, but uniform for each of said subsequences in each of said sequences respectively, whereby said minimum average speed may be set differently for each contestant according to his/her playing strength.

14. The timing device as claimed in claim 11 wherein said second means is designed to accept and store as input a required number of events that (a) repeats for each of said subsequences in each of said sequences and (b) is different for corresponding subsequences in each of said sequences, whereby said required number of events may be set differently for each contestant according to his/her playing strength.

15. The timing device as claimed in claim 11 wherein said second means is designed to accept and store as input a required number of events that (a) varies for each of said subsequences in each of said sequences but (b) is the same for corresponding subsequences in each of said sequences.

16. The timing device as claimed in claim 11 further comprising a means for calculating and displaying the number of events completed in the current subsequence in each of said sequences respectively.

17. The timing device as claimed in claim 11 further comprising a means for calculating and displaying the number of events remaining in the current subsequence in each of said sequences respectively or, as a negative number, the number of events in excess of that required in the current subsequence, whereby the number of events completed in excess of that required, if any, may be subtracted from the number initially remaining in the next sequence.

18. The timing device as claimed in claim 11 further comprising a means of transition from the current of said subsequences to the next, wherein (a) said transition occurs when time has run out on the corresponding of said clock means and (b) the number of events completed in excess of said required number for the current of said subsequences is subtracted from said required number for the next of said subsequences.

19. The timing device as claimed in claim 11 further comprising a means of transition from the current of said subsequences to the next, wherein (a) said transition occurs when said required number of events in the current of said subsequences is completed and (b) the time remaining on the corresponding of said clocks is added to said initial time allotted for the next of said subsequences.

* * * * *